United States Patent [19]

Borisov et al.

[11] 4,015,671

[45] Apr. 5, 1977

[54] ELECTRIC HAMMER

[76] Inventors: Vladimir Mikhailovich Borisov, ulitsa Grekova 14, kv. 69; Boris Grigorievich Goldshtein, Molodogvardieskaya ulitsa 24, korpus 1, kv. 26; Albert Adlofovich Goppen, Novocheremushkinskaya ulitsa 44, korpus 2, kv. 90; Vladimir Alexeevich Eletsky, ploschad Vosstania 1, kv. 12"a".; Viktor Lvovich Sherman, Leningradskoe shosse, 7/2, kv. 606, all of Moscow; Kherbert Zhanovich Bush, Komsomolskaya ulitsa 13, kv. 23, Daugavpils; Nikolai Pavlovich Ryashentsev, Krasny prospekt, 50, kv. 53; Evgeny Mikhailovich Timoshenko, ulitsa Sibiryakov-Gvardeitsev, 8, kv. 51, both of Novosibirsk, all of U.S.S.R.

[22] Filed: Apr. 17, 1973

[21] Appl. No.: 352,030

[52] U.S. Cl. ..... 173/117; 173/119; 173/139; 175/56

[51] Int. Cl.[2] ..... B25D 11/06

[58] Field of Search ..... 173/117, 119, 139; 175/56; 267/137, 136; 310/30, 34, 35; 318/114

[56] References Cited

UNITED STATES PATENTS

| | | | |
|---|---|---|---|
| 1,853,695 | 4/1932 | Mortimer | 173/119 |
| 2,055,001 | 9/1936 | Blomquist | 173/119 |
| 2,536,971 | 1/1951 | Weyandt et al. | 173/117 |
| 2,861,778 | 11/1958 | Spurlin | 173/139 |
| 2,949,909 | 8/1960 | Macchioni et al. | 175/56 |
| 3,460,637 | 8/1969 | Schulin | 173/117 |

FOREIGN PATENTS OR APPLICATIONS

| | | | |
|---|---|---|---|
| 304,519 | 9/1914 | Germany | 173/117 |

*Primary Examiner*—Ernest R. Purser
*Assistant Examiner*—William F. Pate, III

[57] ABSTRACT

An electric hammer comprising a housing accommodating a stator, a hammer piston reciprocably mounted in the stator, and a shock absorber including a resilient member and an intermediate member disposed between the hammer piston and the resilient member, the mass of the intermediate member being greater than that of the hammer piston.

2 Claims, 1 Drawing Figure

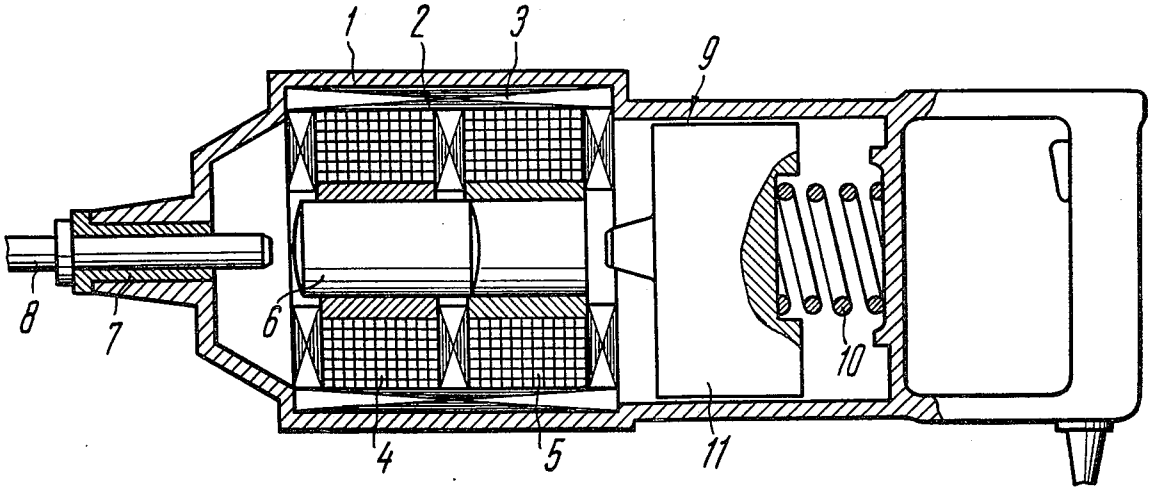
1
2
3
4
5
6
7
8
9
10
11

ELECTRIC HAMMER

The present invention relates to the impact action handheld electric tools, such as hammers, rock drills and rammers, and more specifically to electric hammers in which a hammer piston is moved due to electromagnetic interaction of the hammer piston and the stator.

The invention may be used in construction and erection jobs, as well as in the road building, where an operator holds the hammer in hands. The requirements to these hammers involve low vibration level, high specific power output per unit of weight, reliability and durability of components and assemblies.

Known electric hammers comprise a housing accommodating a stator and a hammer piston reciprocating in the stator at a certain frequency. The work stroke of the hammer piston is completed with a blow imparted thereby to a tool (e.g. drill steel), and the return stroke is completed with an impact engagement with a shock absorber, which is mounted in the housing and consists of a resilient member (such as spring) and an intermediate member disposed between the hammer piston and the resilient member. As a result of the impact engagement deformation of the resilient member takes place, and the resilient member causes the reverse of the hammer piston.

In this construction the forces associated with the interaction of the hammer piston and the resilient member are transmitted directly to the hammer housing, and a time period of the interaction $t$ constitutes a fraction of the total operation cycle T of the hammer (that is a time interval between the two successive blows). Average force $F_1$ of the interaction of the housing and the resilient member is determined by the necessity of developing during the time period t a power impulse, which is substantially equal to twice the momentum of the hammer piston at the instant of its impact engagement with the shock absorber $$F_1 = \frac{2m_1V}{t}$$

wherein $m_1$ is mass of the hammer piston;

$V$ is speed of the hammer piston at the instant of its impact engagement with the shock absorber.

This force is applied during a short fraction of the cycle and is by several times greater than the thrust applied by an operator to the hammer handles, thus negatively affecting the working conditions.

Other disadvantages of the known construction consist in the following:

service life of the resilient member is short since the resilient member absorbs the entire kinetic energy of the hammer piston accumulated during its return stroke and is loaded at a rate equal to the speed of the hammer piston;

upon acceleration of the hammer piston the resilient member and the intermediate member of the shock absorber will still have a considerable speed and will slow down due to the impact engagement with a component connected to the housing, thereby resulting in increased noise and vibration, the latter afffecting the durability of the hammer electric assemblies;

the time period of the reverse of the hammer piston, where its speed is relatively small, is commensurable with the operation cycle, whereby the average value of the counter-EMF induced in the stator coils is reduced, and the currents and the heat lossess in the coils are increased.

It is an object of the invention to eliminate the above-mentioned disadvantages.

The invention consists in the provision of an electric hammer having such a construction as to ensure substantially instantaneous reverse of the hammer piston, while the time period, associated with the reverse of the hammer piston and during which the interaction of the resilient member and the housing occurs, should be equal to the entire operation cycle of the hammer.

The above object is accomplished by that an electric hammer comprising a housing accommodating a stator, a hammer piston reciprocably mounted in the stator, and a shock absorber consisting of a resilient member and an intermediate member disposed between the hammer piston and the resilient member, according to the invention is characterized in that the intermediate member has a mass greater than that of the hammer piston.

The mass of the intermediate member of the shock absorber is preferably by 1.2–3.5 times greater than the mass of the hammer piston.

It is advantageous to select the mass of the intermediate member and the force of the resilient member based upon the condition according to which a ratio between the natural frequency of the intermediate member and the stroke frequency of the hammer piston should be between (0.25–0.6).

The invention will now be described in detail with reference to a specific embodiment of the hammer illustrated in FIG. 1 of the accompanying drawing, which shows a longitudinal sectional view of the hammer.

The hammer according to the invention comprises a housing 1 accommodating a stator 2 having a magnetic circuit 3 and electromagnetic coils 4 and 5; mounted in the stator is a hammer piston 6. Mounted in the front portion of the hammer is a tool holder 7 with a tool 8 fixed therein; the rear portion of the housing accommodates a shock absorber 9, which consists of a resilient member — spring 10 — and an intermediate member 11.

The above-described hammer functions as follows. Upon feeding a current pulse to the coil 4 the hammer piston 6 will impart a blow to the shank of the tool 8 and will rebound therefrom. Then a current pulse is fed to the coil 5, and the hammer piston, being accelerated in the opposite direction, will come into an impact engagement with the intermediate member 11 to rebound therefrom, whereafter the hammer piston is acted upon by the coil 4, which becomes energized by this moment.

At the same time, the intermediate member 11 will move rearward at a speed imparted during the impact engagement with the hammer piston to compress rather weak spring 10, will stop and then travel under the action of the spring 10 toward the hammer piston 6 which returns back upon imparting a blow to the shank of the tool 8. The impact engagement between the intermediate member 11 and the hammer piston 6 takes place, the hammer piston now receiving the energy, which was transmitted thereby to the intermediate member 11 during the preceding impact engagement therewith. The hammer piston 6 and the intermediate member 11 will again move apart, and the cycle is repeated.

The necessary condition of stable operation of the electric hammer consists in that the intermediate member 11 should return back substantially to one and the same point by every instant of the next impact engagement with the hammer piston 6. With the resilient member 10 having linear characteristic, this condition can be strictly fulfilled independent of the force of the preceding impact engagement with the hammer piston 6 in the case, where the natural frequency $f_o$ of oscillations of the intermediate member on the resilient member is equal to one-half of the hammer blow frequency $f$ $$f_o = \frac{1}{2} f = \frac{1}{4\pi} \sqrt{\frac{C}{m_2}}$$

wherein $C$ is force of the resilient member;

$m_2$ is mass of the intermediate member.

The experience of the design practice shows that it is required to have the point of the impact engagement being displaceable relative to the housing with a change in blow intensity, for instance, due to fluctuations of the supply voltage. In order to do so, $f_o$ should have values different from ½ $f$.

It is preferable, that $f_o$ range over (0.25–.06) f.

The hammer according to the invention has the following advantages.

Since in the hammer according to the invention the forces associated with the reverse of the hammer piston are not transmitted directly to the housing, but rather via the intermediate member 11, which will prolong the power impulse acting upon the housing 1 via the spring 10 during the entire time period of the cycle, that is during the time period T, the average force $F_2$ associated with the interaction of the resilient member and the housing $$F_2 = \frac{2m_1 V}{T}$$

is considerably smaller than in the known construction, that is $F_2 < F_1$ since $T > t$. The vibration level on the housing and handles of the hammer is also respectively lowered.

Additional advantages of the invention consist in the following:

the resilient member accumulates the energy of the intermediate member, which is by $$K = \frac{m_2}{m_1}$$

times lower than the kinetic energy of the hammer piston, which is important for long-term operation of the resilient member;

since the intermediate member is stopped upon the impact engagement with the hammer piston and travels back in the opposite direction, it will not come into impact engagements with the hammer housing, thus additionally lowering vibration, noise and heating of the housing and improving the reliability of the electric assemblies of the hammer;

due to the fact that during the reverse of the hammer piston there is substantially no such a time period during which the hammer piston would move slow without inducing considerable counter-EMF in the coils, the coils heating is lowered.

The range of expedient ratios $$K = \frac{m_2}{m_1}$$

is determined by the following considerations.

Since the shock absorber is stationary at the first blow, steady starting of the hammer is possible only with $K>1$.

However, with K approximately equal to unit negative phenomena occur, and namely:

amplitude of oscillations of the intermediate member is considerably increased, thereby requiring an increase in overall dimensions of the hammer and resulting in greater load imposed upon the resilient member;

larger amplitude of oscillations of the intermediate member results in increased mechanical friction lossess.

The minimum expedient value of K is equal to 1.2.

With an increase in K, that is with an increase in $m_2$ with $m_1$ = const, the lossess are reduced, thereby permitting to increase the power output with the same heating, while the ratio between the power output and the weight is also improved.

The upper limit is determined by the fact that with an increase in K the loss level is stabilized, and further increase in K up to $K>3.2$ will only result in greater weight of the hammer without bringing about the corresponding proportional increase in the power output.

The range of the expedient values of K for hand-held hammers is $K = 1.2–3.2$.

Therefore, the invention makes it possible to provide a hammer having lower vibration (lower by about 8–18 dB) with small weight and improved reliability.

What is claimed is:

1. An electric hammer comprising: a housing; a stator accommodated in said housing; a hammer piston reciprocably mounted in said stator; a shock absorber accommodated in said housing and including a resilient member and an intermediate member disposed between said hammer piston and said resilient member; the mass of said intermediate member of the shock absorber being greater than the mass of said hammer piston, the mass of said intermediate member of the shock absorber and the force of said resilient member being determined by the ratio between the natural frequency of oscillations of the intermediate member and the stroke frequency of the hammer member, said ratio being substantially equal to (0.25–0.6).

2. An electric hammer comprising: a housing; a stator accommodated in said housing; a hammer piston reciprocably mounted in said stator; a shock absorber accommodated in said housing and including a resilient member and an intermediate member disposed between said hammer piston and said resilient member; the mass of said intermediate member of the shock absorber being greater than the mass of said hammer piston by 1.2 to 3.2 times, the mass of said intermediate member of the shock absorber and the force of said resilient member being determined by the ratio between the natural frequency of oscillations of the intermediate member and the stroke frequency of the hammer piston, said ratio being substantially equal to (0.25–0.6).

* * * * *